US012723769B2

(12) United States Patent
Riddle

(10) Patent No.: US 12,723,769 B2
(45) Date of Patent: Sep. 1, 2026

(54) PERSONAL DESKTOP AIR CURTAIN

(71) Applicant: Nathan Carrol Riddle, Burton, MI (US)

(72) Inventor: Nathan Carrol Riddle, Burton, MI (US)

( * ) Notice: Subject to any disclaimer, the term of this patent is extended or adjusted under 35 U.S.C. 154(b) by 375 days.

(21) Appl. No.: 18/414,062

(22) Filed: Jan. 16, 2024

(65) Prior Publication Data

US 2025/0230938 A1 Jul. 17, 2025

(51) Int. Cl.
*F24F 9/00* (2006.01)

(52) U.S. Cl.
CPC ..... *F24F 9/00* (2013.01); *F24F 2221/12* (2013.01)

(58) Field of Classification Search
CPC ..... F24F 9/00; F24F 2221/12; A47B 2200/06; F04D 29/44
See application file for complete search history.

(56) References Cited

U.S. PATENT DOCUMENTS 3,211,077 A * 10/1965 Kramer, Jr. ..... F24F 9/00 165/122
2010/0175556 A1 7/2010 Kummer et al.
2014/0060396 A1* 3/2014 Landvik ..... F24F 13/0604 108/50.13
2020/0080684 A1* 3/2020 Asante ..... A47B 19/06

FOREIGN PATENT DOCUMENTS

GB 2606755 A * 11/2022 ..... F24F 8/10
TW M500163 U * 5/2015 ..... F24F 13/0604

OTHER PUBLICATIONS

English translation of TW-M500163-U, dated Mar. 20, 2026 (Year: 2026).*

* cited by examiner

*Primary Examiner* — Michael G Hoang
*Assistant Examiner* — Brett P. Mallon

(57) ABSTRACT

An air curtain, thin and uniform in velocity across its width, is produced by a low cost, miniaturized, modular device for use at a desktop as a personal protection from airborne contaminants. A rear facing, thin centrifugal blower discharges air tangentially, which is redirected to form several air zones. Flow is made uniform in velocity across each zone width and zones recombine and reflected in a reversed flow path to the front to form an air curtain. Advancements are in flow smoothing by a corrugated baffle and laminar air flow in a corrugated board. Parts are cut from low cost plastic corrugated architectural panels and sealed in a thermal formed case. Multiple modules are combined to isolate a desktop area or provide an air curtain up the body in point-of-use ventilation. Admits to scaling to larger work areas. USB cable or USB battery powered.

1 Claim, 3 Drawing Sheets

PERSONAL DESKTOP AIR CURTAIN

CROSS-REFERENCE TO RELATED APPLICATIONS

This Application claims priority to U.S. Provisional Patent Application No. 63/488,529 filed on Mar. 6, 2923; U.S. Provisional Patent Application No. 63/488,728 filed on Mar. 6, 2023; and to U.S. Provisional Patent 63/488,947 filed on Mar. 7, 2023, the contents of which are incorporated herein by reference.

PRIOR ART

U.S. Pat. No. 3,211,077

BACKGROUND OF THE INVENTION

Field of Invention

The present invention relates generally to an air flow control apparatus, and more specifically, to a modular device to produce a thin, uniform air stream as personal protection against airborne particulates or other airborne contaminants and using low cost, miniaturized components sized for desktops. The air stream may be called by names such as air curtain, air shield, air partition, air barrier, air wall, air dam, air field, air knife, or other names.

Description of Related Art

Patents for air curtains for entryways appeared using nozzles and compressed air near the end of the 1800's. Since then, a variety of air movers have been used. There have been rows of simple bladed fans with inlet and outlets flows parallel to the drive axis, centrifugal fans with inlet flows parallel to the axis and outlet flows radial to the axis, cross flow fans with both inlet and outlet flows perpendicular to the axis and long blades along the axis. In some installations, the air is reflected from a surface to produce a more uniform curtain. A wide variety of air curtain designs are used in manufacturing, chemical processes, and transportation. By the mid-1900's, air curtains were being used in open refrigerated food displays, which inspired many patents. By the end of the 1900's, air curtains were being used to provide protection against hazards of infection. Inventors responded to the 2020 COVID-19 pandemic with a plethora of patent applications for air curtain devices that then received patents in 2022 and 2023.

This present invention for the protection from airborne hazards is one of those responses. It uses a short bladed centrifugal blower, which is in contrast to simple fans typically used in personal protection devices but can still be used to produce a thin but wide air curtain. The greater air pressure of centrifugal blowers can overcome greater flow restrictions of filters and flow shaping components.

An existing example of such a device is U.S. Pat. No. 3,211,077, Air Curtain (1965), which is conceptually and functionally equivalent to the present invention, but was not known at the time of the above referenced provisional patents; however, the present invention comprises novel alternative instances of features and has the advantage of materials not available to the inventor at the time of invention. Disclosure is now made in a disclosure form. Forward patent searches referenced to the example are primarily for small air conditioners having notably different structures and purpose. Noteworthy, is a use of a triangular pyramid vane to provide a full 180 degree reversal of air flow from an inlet of warm room air to an outlet of cooled air to the room.

After the recent pandemic and the many related mandates, there has developed among the populace a strong resistance to mandates to wear full face respirators ("masks"). In infection wards of hospitals, there has been a shift from masks to expensive powered air respirators where a filtered air curtain is directed downward in the space between the face and a plastic face shield. Blowers and filters are waist mounted with tubes to the shield. The earlier use of plastic desk shields on office and school desks has been discredited as interfering with room ventilation and thereby increasing the risk of transmitting airborne infection when improperly placed.

The large number of patents on industrial entryway air curtains and on air curtains in open refrigerated food displays can provide guidance here. There is published research on air curtains in the hospital use of air curtain umbrellas at consulting desks, air fences around beds, slotted intakes at bed headboards and point-of-use displacement ventilation at a desk edge. U.S. Pat. No. 10,018,369 B2 discusses the principles applying to parallel flow in providing non-turbulent flow that is resistant to flow interruptions and a method of of using focused flow to sharpen the velocity profile.

These principles are evident in a downward flowing desktop air curtain device in a hospital blood sampling station in the NPL disclosure (1), which reports extensive research in its effectiveness in blocking coughs. It uses an airfoil to focus the air flow to sharpen the velocity profile of the thickness of the curtain. It is a large desktop device and uses duct work to AC powered fans on the floor. Curtain air filters were optional. This publication (Japan) was widely reported globally in public media.

An example of a related, but larger device is patent US 20220010988 A1 which provides a canopy with an air curtain sweeping downward over a table. However, this applies to specialized installations.

An example of an embodiment of an upward flowing air curtain is a desktop bio-safety cabinet, patent US 20220120459 A1. A box on the center of a table provides a vertical air curtain.

An air curtain blowing up the body can serve as ventilation, as well as provide personal protection as in U.S. Pat. No. 5,238,452.

Patent US 20230146091 A1, Airfield Systems, Devices, and Methods, is an all-inclusive coverage of industrial air curtains.

Since a subject of this patent application is miniaturized air curtains, it is instructive to point to mobile devices, such as head gear with air curtains. This topic has been exhaustively detailed in patent US 20230338603 A1, Device For Generating Upwardly Flowing Air Curtain.

An example of a simple device, but embodying the elements of head gear air curtains, is patent US 20220331619 A1. It contains a fan with a filter, a conduit on the top of the head, and a supporting headband with a laminar section directing an air curtain downward over the breathing zone.

A pre-COVID-19 pandemic example, US 20100175556 A1, has the same goals and the same possible embodiments as the present invention but uses a long cross flow fan wrapped in a filter housing. It appears to be an adaption of a commercial product for a doorway air curtain. In one embodiment common to the present invention, clean air flows up the body and directly into the breathing zone and is known, in the current vernacular, as point-of-use ventilation. The centrifugal fan in the present invention allows a more compact design, ease of mounting and powering with common batteries.

An example of a highly technical, electronic control of air flow in head gear is patent US 20230209237 A1, which is a widely known commercial product.

An important advancement in air curtains as personal protection is a head visor or safety hat with an air curtain and an air sanitizer using cold plasma, WO 202210988 A1 (US 20220126126 A1). This is the outcome of university research for the meat packing industry, which was severely affect by the recent pandemic.

There is a need for an alternative to face masks in early schooling. Face masks poorly served the needs of small children for personal respiratory protection in the recent pandemic. If they would wear them, they often slipped out of position; the efficiency in removal of particulate material was low; and there was no program for testing of guidance for use, for certification of efficiency, or for their effectiveness for children. Masks are very disruptive in learning and the alternative of remote schooling has been documented to result in learning loss.

A miniature, low cost, low noise, low power and movement enabling air curtain can fill the loss of mask protection in situations of long duration and close interaction in offices and schools where persons are seated at desks or tables. The wide availability of low cost accessories, such as phone bank batteries as a power sources and universal filters, enables acceptance.

The cost of materials and ease of manufacturing can affect the cost. The use of modules allows scaling and customizing of air curtains at lower cost. The cost of the personal desktop air curtain in this invention is twice the cost of a single certified N95 full face respirator, but it is a durable, rather than a disposable, solution. Some actual instances of use in a classroom setting validates its use there.

SUMMARY OF THE INVENTION

For clarity, this summary relies on the narrative thread in the summary of U.S. Pat. No. 3,211,077 (1965), Air Curtain, which is referenced here as prior art for comparison and contrast.

A thin, high speed, low noise, low current centrifugal blower is located in a case near an air discharge end (front) of a bottom board with the blower outlet facing the sealed end (rear) and receives power from a USB cable. A sealed case (2) is formed by a flat top and four lateral sides, with edges, of a thermal formed plastic and the bottom board of a corrugated material. Air enters the case through a round hole in the top of the case. The air flows from the blower outlet (8) exits the case by passing through a novel baffle (16) and then to the sealed end (rear) of the case and there enters a lower trench (18) through the top surface layer of the bottom board of corrugated material, which is comprised of an array of tubes in a panel. In a reversed-flow path, the air flow then moves forward toward the air discharge end through the bottom board of corrugated material, and travels the full length of the bottom board and exits as the air discharged (5) from the device.

In the reference patent, the blower outlet has 3 vanes which divides the air flow into 4 air flow zones. In this invention, 1 partial dam (11) (vane) in the lower half (or upper half) of the air of the blower outlet forms 4 air flow zones (two sides and two layers).

In the reference patent, the 4 air flow zones are fluidically connected to a screen partition, which smooths flows passing through it. Here, the 4 zones are fluidically connected to two transition pieces (14,15) of corrugated material to convert the dimensions of air flow from the blower outlet to the dimensions of the exiting air discharge from the device. The two transition pieces fluidically connect to a 2 layer baffle (16) and provides some smoothing of the air flow.

In the reference patent, the air flow exits the screen and enters a duct where 4 parallel metal duct sheets bend (reflect) the air flow downward at a right angle and forms a laminar-like air curtain. Here, the air flows from the two layers of the baffle are fluidically connected in a right angle turn to a single layer in the bottom board (2), where the tubes comprising the bottom board induce laminar flow. A mixing mask (17) in the entrance to the single layer bottom board acts as a fine adjustment of air mixing. The air flows through the bottom board and exits the air discharge (5) in a thin, laminar, uniform velocity air curtain.

DETAILED DESCRIPTION OF THE INVENTION

Definitions and General Preferences

Where used herein and unless specifically indicated otherwise, the following terms are intended to have the following meanings in addition to any broader (or narrower) meanings the terms might enjoy in the art:

Unless otherwise required by context, the use herein of the singular is to be read to include the plural and vice versa. The term "a" or "an" used in relation to an entity is to be read to refer to one or more of that entity. As such, the terms "a" (or "an") and "one or more" are used interchangeably herein.

The phrases "corrugated material", "corrugated board" and "laminar flow piece" refer to the same material. The term "fluidically" is the preferred adverb rather than "fluidly". USB is the abbreviation for the Universal Serial Bus specification for communication cables for computers, digital devices and power sources. A newer version with higher available power is the Universal Serial Bus 2 (USB2). "N95 mask" refers to a disposable full face respirator certified by the National Institute for Occupational Safety and Health (NIOSH). The term "kneehole" is a term used by the furniture industry for the space under a desktop where a person's knees and legs may be positioned while fully seated at a desk. The word "tape" or "taped" refers to thin (nominally 1 mm [0.04 in]) double side mounting tape, unless otherwise specified. "Seal", "sealed" or "sealing" refers to connecting surfaces with tape, food grade silicon caulking, solvent cement, thermal welding or ultrasonic welding and filling holes or tubes with said caulking.

EXEMPLIFICATION

The invention will now be described with reference to a specific example:

Dimensions of any construction material may not be precise since its tubes may vary slightly in size and shape across the width of a sheet and among sheets. As a result, walls in stacked layers may not align and the bottom of the device may vary by one tube.

The blowers, the materials used and the device size in this example of the claimed invention do not encumber the possible variations covered by this invention.

Figure 1:
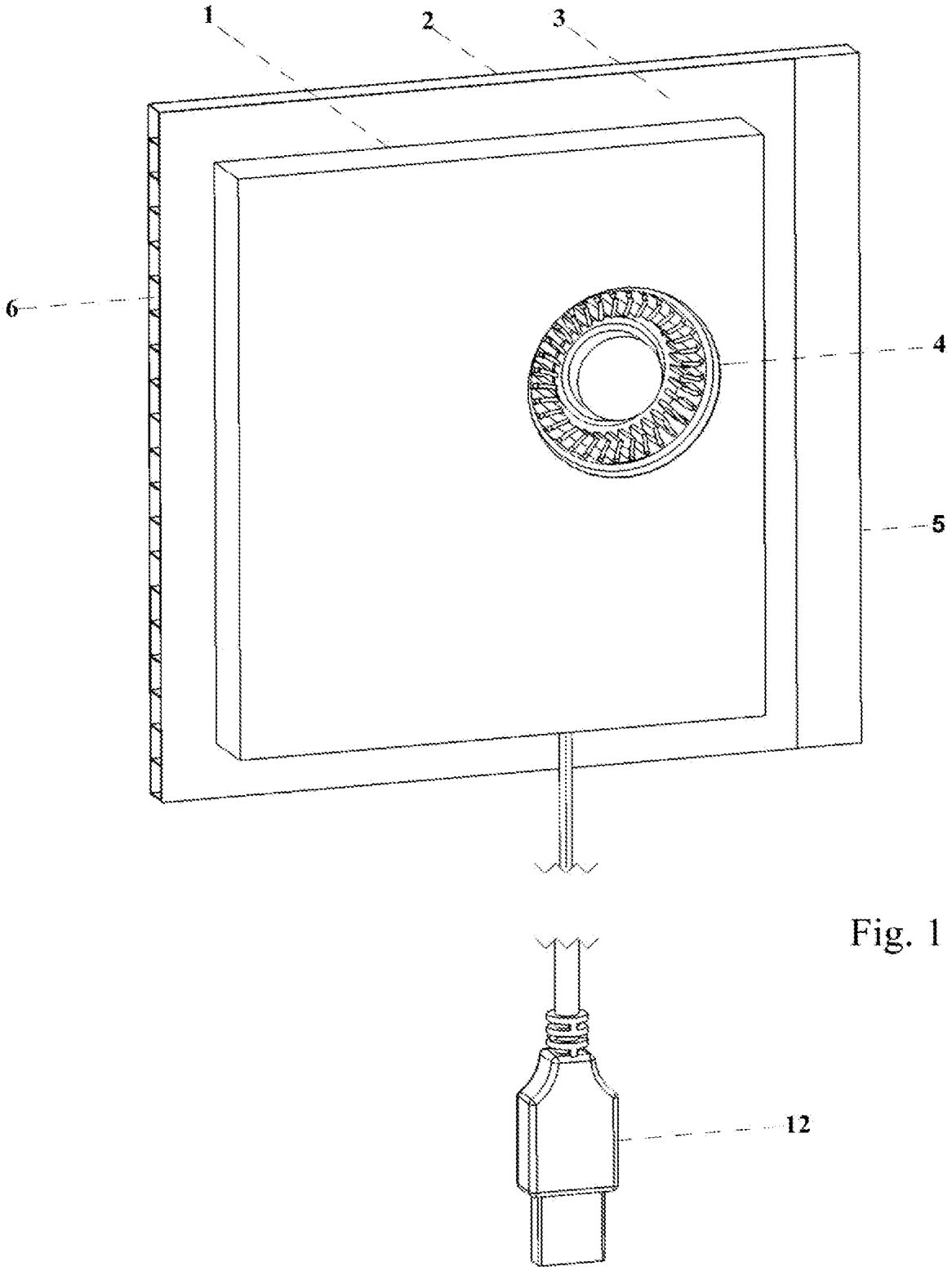
FIG. 1. This is a drawing to scale of the overall view of the case of the invention with the case in place.

FIG. 1, a case (1), has inside dimensions of 95 mm (3¾ in) by 108 mm (4¼ [in]) by 14 mm (0.55 in) and is sealed with tape (3) to a bottom board (2) of a corrugated material to form a sealed volume. The case consists of a thermally formed box using 0.5 mm (0.020 in) thermal plastic film and having 10 mm (0.39 in) outwardly flared bottom edges. The case has a hole (4) in a round shape, 32 mm (1.25 in) in diameter, in the top of the case (1) to access an air inlet (9) of the centrifugal blower (7) in FIG. 2. The hole is cut with a 32 mm (1¼ in) chassis hole punch. The hole is cut to coincide with the air inlet of the centrifugal blower after mounting. Foam mounting tape seals the blower inlet (8) to the hole (4) in the top of the case. An "O" ring, 33 by 38 by 2.4 mm (1⁵⁄₁₆ by 1½ by ³⁄₃₂ in) is an equivalent seal. Said bottom board (2) is comprised of a corrugated material of many parallel tubes in the form of a panel. In FIG. 3, The bottom board (2) has one end sealed and is designated as a sealed end (6) and a lower trench (18) cut into the surface near the sealed end. There is a USB power cord (12). Thermal forming with vacuum, used to form the case, (1) is a common art used for food containers and modeling and a variety of materials and equipment are available in industry and from suppliers to hobbyists. Semi-automated, integrated thermo-vacuum formers are available to hobbyists for up to 400 mm (15.7 in) by 800 mm (31.6 in) and up to 500 cycles per day.

Figure 2:
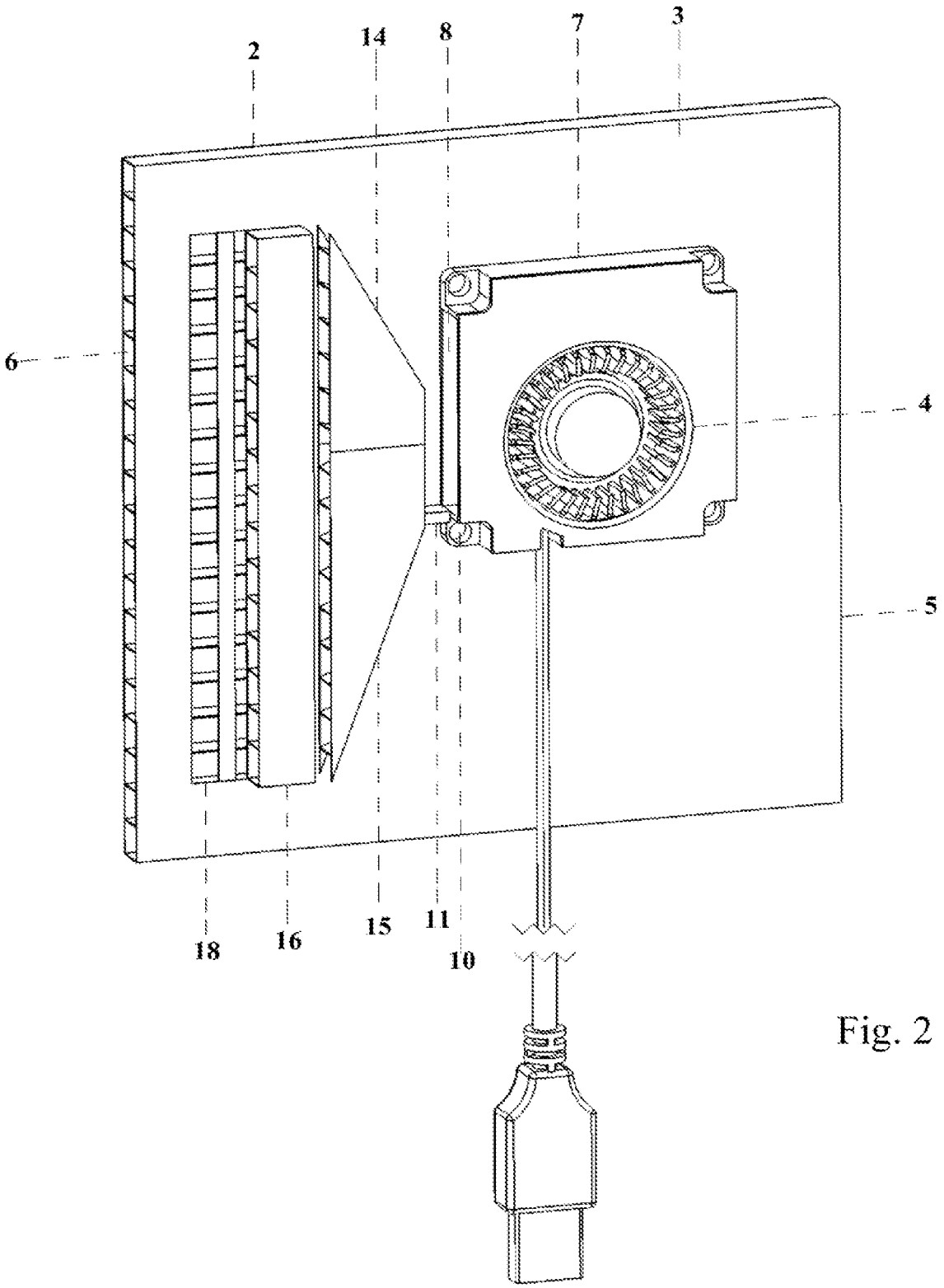
FIG. 2. This is a drawing to scale without the case (1) and showing the bottom board (2) and the lower of two layers of other components. The major components are shown in block form.
Figure 3:
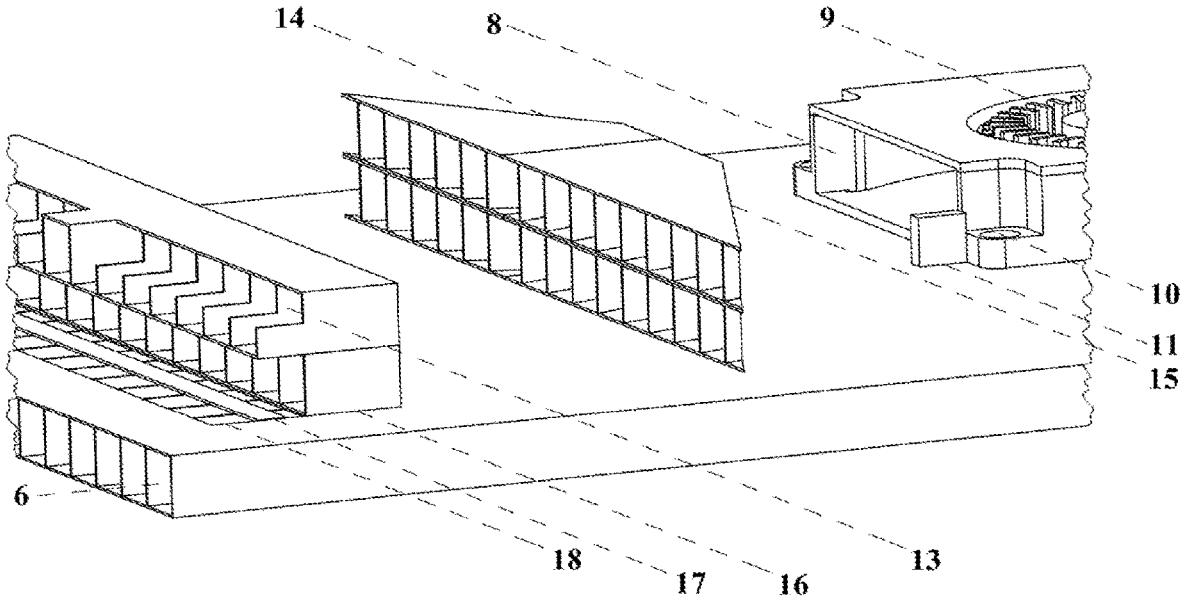
FIG. 3. This is an Illustration without the case (1) and as an exploded view using a representative number of tubes in the corrugated material and not to scale. In doing so, attention is drawn to the structure, and to the understanding, of the primary novel feature of the claimed invention, the zone forming the uniform flows and which is between the baffle (16) and the entrance to the corrugated bottom board (2): baffle (16), upper trench (13), mixing mask (17), and lower trench (18) in the bottom board (2).

In FIG. 2, a square centrifugal blower (7) of size 50 mm (1.97 in) comprising a blower inlet (9) of size 32 mm (1¼ in) in diameter and a blower outlet (8) of size 40 mm (1.56) in by 10 mm (0.39 in) which faces a sealed end (6).

The blower is mounted with tape at 5 mm from the two transition pieces (14, 15) [width of a tube of the bottom board (2); or an equivalent 35 mm from an inboard edge of the lower trench (18)] and the axis of the blower is centered between two sides of the bottom board (2), which is 127 mm (5 in) by 127 mm with square tubes about 4.5 mm square (0.18 in) with 1.5 mm (0.06 in) walls. The blower discharges the air towards a second side at about a 45 degree angle. A combination of a first transition piece (14) and a second transition piece (15) is to adapt the dimensions of the blower outlet (8) to the inside dimensions of the case. An air dam (11) (vane) forces the lower half of the air flow of the blower outlet (8) toward the first side and the air flow fluidically connects to the inlet of the two layers of the first transition piece (14) and the upper half of the air flow of the blower outlet (8) continues to the second side and the air flow fluidically connects to the inlet of the two layers of the second transition piece (15).

The transition piece (14) fluidically connects at an angle to the first side of a baffle and the air flow impacts the entrance plane of the baffle. The first transition piece (14) has been cut so that the slope of its tubes of the corrugated material is between 67 to 73 degrees to the first side of the center line between the two said sides.

The second transition piece (15) fluidically connects at an angle to the second side of the baffle and the air impacts the entrance plane of the baffle. The second side transition piece (15) has been cut so that the slope of its tubes of the corrugated material is between 67 to 73 degrees to the second side of the center line between the 2 said sides.

The two said transition pieces (14,15) do not touch the baffle and between 2 to 3 mm (0.079 to 0.12 in) spacing is acceptable.

The air flow passes through the baffle (16) and into the upper trench (13) and then into the lower trench (18). The lower trench is 108 mm by 10 mm (0.39 in) and is cut to a depth of 2 mm (0.079 in) in the bottom board (2) of corrugated material. The lower trench contains a mixing mask (17). The outlet of the baffle is fluidically connected to the lower trench through a 90 degree bend. The primary function of the mixing mask (17) is to adjust the ratio of air flow from the two layers of the baffle (16) into the lower trench (18) comprised of one layer of the bottom board (2). It also causes some back pressure that forces some lateral balancing of the air flow in the upper trench (13) towards each side, separately. The mixing mask (17) is 0.25 mm (0.01 in) thick and 3 mm (0.012 in) in width and 105 mm (4.13 in) in length, in the default. The mixing mask (17) can be moved towards the outboard or towards the inboard edges of the lower trench and the mixing mask can be shaped to affect balancing at assembly time.

0.25 mm (0.01 in) thick and 3 mm (0.012 in) in width and 105 mm (4.13 in) in length, in the default. The mixing mask (17) can be moved towards the outboard or towards the inboard edges of the lower trench and the mixing mask can be shaped to affect balancing at assembly time.

In a reversed-flow path, the air then flows forward through the corrugated bottom board (2), and travels toward the air discharge (5) of the bottom board (2) and exits the bottom board as said air curtain of the device. The sealed edge (6) of the bottom board is sealed with food grade silicon caulking. The USB power source is a user's laptop, or a USB adapter to building power or a phone power bank (battery).

The baffle (16), the first transition piece (14) and the second transition piece (15) are made from two layers of the corrugated material used in the bottom board. (2). The upper layer of the baffle is 15 mm (0.59 in) by 108 mm. (4¼ in). The lower layer of the baffle is 10 mm (0.39 in) by 108 mm (4¼ in). The two transition pieces are special and are discussed later The flat top of the case (1), permits replaceable dust filters, efficient particulate filters or chemical filters to be mounted on the case with double side foam tape. With larger centrifugal blowers, available filters include a common 75 mm (3 in) by 100 mm (4 in) by 25 mm (1 in) pleated, high efficiency particulate air filter (HEPA) cassettes similar to those used on the bleed air of domestic centrifugal vacuum cleaners. If a user chooses to use a filter in point-of-use ventilation, media can be cut from filters used in the building ventilation.

The centrifugal blower is 50 (2 in) square, 10 (0.39 in) in thickness and operates on 5 volts at 0.25 amperes at 5700 rpm for a free flow to 56 liters per minute (2 cubic feet per minute) with a noise rating at 25 dB at free flow. Suitable 5 volt blowers are available in dimensions of 10 and 15 mm (0.39 to 0.59 in) in height and 50 and 60 mm (1.97 to 2.36 in) in a square footprint and currents of 0.1 to 0.4 amperes. Their speed is between 4500 and 6000 rpm air; flows are between 28 and 196 liters/min (1 and 7 cfm); and a noise level is between 25 and 30 dB. Such blowers are used for cooling in 3D printers. The power requirement fits into the specifications of the 5 volts, 0.5 amperes (0.9 amperes for newer USB2) maximum of USB ports in personal computers. Low cost, 5 volt, 2 ampere USB adapter modules to room wall power are widely available. 10 watt-hour phone power bank (battery) often contains 2 USB ports rated at 1.5 to 2.5 amps for each port. This would provide in excess of 30 hours of operation. 10 watt-hour units are as small as 6 cm by 9 cm by 1.2 cm (2.4 in by 3.5 in by 0.47 in).

The bottom board (2), consists of a panel of square tubes, 4.5 mm (0.18) inside width, with walls of 0.2 mm (0.018 in) thickness (¼ inch tube). The material is thermal plastic PETE or PETG, which is sold in sheets as architectural panels. The material is similar in form to corrugated cardboard used in shipping boxes. A disposable version of the invention with a removable blower drawer will be obvious to those skilled in the art.

In FIG. 2, the lower layer of the transition piece (14) and the lower layer of the transition piece (15) are taped to the bottom board (2) with the shortest straight edge at a distance of 5 mm (0.197 in) from the blower outlet (8). In FIG. 3) there is a lower layer and an upper layer in both transition piece (14) and transition piece (15). Upper and lower layers are taped together. The 4 pieces are cut from a piece of the corrugate material used for the bottom board and cut at a 20+/−3 degree angle across its tubes. This is an angle to assure that every air path exiting a transition piece tube hits a tube wall while in the baffle section and results in turbulence within the baffle. This is the same observed effect as the resonance produced by blowing into a drinking straw at a slight angle from the perpendicular into the straw. A dam (11) for the air flow (vane) for the lower half of the blower outlet (8) is formed with food grade silicon caulking next to an unused blower mounting hole (10). This dam is about 6 mm (0.24 in) in height by about 5 mm (0.19 In) width by about 2 mm (0.079 in) thickness and is sealed to the second side edge of the blower outlet (8) at the mounting hole (10), to the surface of the corrugated bottom board (2) and against the second transition piece (15).

The baffle piece (16) consists of two layers of corrugated material and are sealed together. The lower piece is a 108 mm by 10 mm (0.39 in) piece. The upper layer is a 108 mm by 15 mm (0.59 in) wide piece and hangs 5 mm (0.20 in) over the lower trench (18) as the front edge of the lower layer is align with the inboard edge of the lower trench (18). There is a 5 mm (0.20 in) deep by 2 (0.08 in) mm high trench cut into the top of the exit edge of the upper layer. Part of the lower trench is a 105 mm (4.13) in) air flow mixing mask (17) with position adjusted and sealed to the top of ridges in the lower trench (18) The default width is 3 mm (0.12 in) wide, but may be changed for fine tuning of flows at the time of assembly.

By positioning the mixing mask (17) toward an inboard or an outboard edge of the lower trench, the ratio of air flow from the lower layer to upper layer of the baffle (16) can be changed. Using a greater width of the mask (17) near the center forces more air to the sides in the trenches (13, 18). The mixing mask shape can compensate for variations in the components. The final air velocities are also affected by the air flow impedance of any filters on the blower inlet (9). Without a filter, air velocities in the air discharge (5) are between 1 and 8 meters per second (16 and 26 ft per second) and provide effective air curtains beyond 381 mm (15) inches. Flows can be set only by adjusting any filter material, filter thickness, varying the exposed area of any filter or varying the cross section area of the flow path.

It is important to pointed out that the primary purpose of an air curtain is to provide a separation of two zones of air to provide protection. The curtain air is, at the users choice, cleaned with particulate or chemical filters mounted on the top of the case (1) or, for point-of-use ventilation, filter material from the building ventilation equipment is, at the users choice, used to polish the air quality that is actually delivered into a person's breathing zone. There is no reference to a filter as being part of the invention in the Claims section. Filters are so varied as to type and purpose, so it is left to any user, as part of the operation, to determine and provide any filter or not use a filter.

Construction of Transition Pieces

For fabricating the first transition piece (14) and the second transition piece (15) FIG. 2 will be helpful. The material is the same as the plastic corrugated bottom board (2) and consist of a panel of tubes. Place a rectangular piece of the board on a flat surface with the tubes vertical. Draw a cut line from the lower left corner at between 17 and 23 degrees from the surface for 305 mm (12 in) and then a vertical line downward to the flat surface. Cut along the cut line. Place the long cut edge of the "cut piece" on the flat surface with the tubes facing vertically. Draw a horizontal cut line at 17 mm (0.67 in) height. Cut along the cut line. From this piece, cut two regular rectangles (all 90 degree angles) 17 mm (0.67 in) in height and 64 mm (2.52 in) in length for the second transition piece (15) and 2 two regular rectangles 17 mm (0.67 in) in height and 40 (1.57 in) mm in length for the first transition piece (14). For a layer of the first transition piece (14) (shorter rectangle), place said piece on a flat surface with the tubes sloping downward. Mark a cut point 10 mm (0.39 in) leftward from the top right corner. Draw a cut line from the cut point to the lower left corner. Cut along the cut line. Repeat for another layer of the first transition piece (14). For a layer of the second transition piece (15), select one of the the longer rectangle pieces and lay on a flat surface with the tubes sloping down to the right. From the top left corner, measure rightward 15 mm (0.59 in) and mark a cut point. Draw a cut line from the cut point to the lower right corner. Cut along the cut line. Repeat for another layer of the second transition piece (15). Tape the two layers of the first transition piece (14) together and tape the two layers of the second transition piece (15) together. The tubes in the upper and lower layers lie in the same direction. In FIG. 2, when mounted on the bottom board (2), the lower layer of the first transition piece (14), and the lower layer of second transition piece (15) are taped to the corrugated board with the shortest straight edge at a distance of 5 mm (0.197 in) from the blower outlet (8). The tubes of the first transition piece (14) slope to the first side toward the baffle (13) and the tubes of the second transition piece (15) slope to the second side toward the baffle (13).

Any cutting across tubes can be done with a hand saw (fine, 32 points/2.5 cm) or a high speed (about 15,000 rpm) rotary tool with a 10 mm (0.39 in) diameter circular saw or a table saw with a 50 mm (1.97 in) circular blade with 12-18 points per 2.5 cm (1 in) at about 8000 rpm. Along the tubes, a sharp utility knife is sufficient. For the upper trench (16) and the lower trench (18), cuts across tubes are best done using a router (or rotory tool accessory) with said 10 mm (0.39 in) saw blade and the workpiece positioned vertically against a fence. For the upper trench (13), the cuts along the tube walls are best done using a sharp utility knife.

As a minimum, use personal safety equipment for eye protection, respiratory protection for fine particulates and good ventilation. When cutting plastic material with high speed saws, organic fumes may be released and may be hazardous to health. Follow all handling and cutting instructions of the manufacturer of the specific plastic material being cut.

EMBODIMENTS

The following embodiments constitute the best modes of currently practicing the claimed invention. The primary embodiment is the single best mode of currently practicing the invention. The design of the device allows for the most simple of methods of installation. The object of the claimed invention is to provide a low cost, simple to construct, simple to install, simple to use and rugged in use and that would actually be practical for used in a classroom in a primary school.

In the following embodiments, it is understood by those skilled in the art that mounting tape is widely used as a low cost method of installing small electronic devices by taping to surfaces:

In the primary embodiment of this modular air curtain device, the device is mounted vertically to the non-seating edge of a desktop or to an object on the desktop and with the fan facing the seating edge. Air flows upward toward the room ceiling. A fundamental requirement for this embodiment and the other following embodiments is that the room has ventilation with exhaust vents in or near the ceiling.

Mounting is accomplished by using mounting tape. The device weighs 57 grams (2 ounces) and up to 13.6 kilograms (30 pound) mounting tape is widely available. There is at least a 12 mm (0.47 in) flat surface at the perimeter of the top side and the entire bottom is available for mounting. The object can be a computer, a block of wood, a plastic base, etc. It is desirable, but not necessary, to mount at an optimal angle of between 15 and 25 degrees from the vertical over the desk or away from the desk. If the air curtain is blowing over the desk, it should blow just over the head. A user may affix to the top of the case, with 10 mm (0.39 in) wide foam mounting tape around the filter perimeter, a filter 80 mm by 120 mm (3.14 in by 4.75 in) flat filter (example: MERV 13 rated). An optional dust filter material is widely available for window mounted air conditioners and the foam mounting tape must be at least 3 mm (0.12 in) thick, or double layers used, to provide clearance for air flow for any filter. Filters also serve as a cover for the rotating blades of the blower. Power for the blower is from a computer, a wall power adapter or battery. An accessory is a "V" shaped plastic strip with an angle of between 65 and 75 degrees for said "object" as a mounting base and is part of the packaging for the device.

The second embodiment comprises the first embodiment with a HEPA filter, classification 12. Tape the filter to the flat top of the case with foam mounting tape which must be at least 3 mm (0.12 in) thick, or double layers used, to provide clearance for air flow. At least one fluted filter cassette with nominal dimensions of 76 mm by 102 mm by 20 mm (3 in by 4 in by 0.79 in) is readily available and one part designation is MC-V194H. Nothing prevents the user from using the device as a clean air air terminal to blow filtered air directly into the breathing zone and there is published research to support the efficacy of this variation of said embodiment.

The third embodiment comprises the device of the second embodiment mounted under the seating edge of a desktop with the fan facing downward. The device is mounted flat under the desk with the front edge of the device at the desk seating edge. An accessory is a rectangular plastic piece having the width of the device and taped under the device edge and is bent upward at angle of between 35 and 45 degrees from the horizontal plane to provide the air flow toward the seated person and upward into their breathing zone in a refreshing of the air quality from the building ventilation at this "point-of-use". The rectangular plastic piece is part of the device packaging.

In the prime, second and third embodiments, multiple modules can be placed side by side to form wider air curtains. Larger phone power banks (batteries) typically have two USB ports for power.

Other embodiments, wherever air curtains are used for personal respiratory protection, will be apparent to those skilled in the art. For example, a simple mounting of this low weight device onto the bill of a baseball hat is in actual use in one instance. The presence of phone power banks in many models of student backpacks opens the use of the device to school bus seating.

PATENT REFERENCES CITED

U.S. Pat. No. 3,211,077-A (1965)
U.S. Pat. No. 10,018,369 B2 (2018)
US 20220010988 A1
US 20220120459 A1
U.S. Pat. No. 5,238,452 A (1993)
US 20230146091 A1
US 20230338603 A1
US 20220331619 A1
US 20100175556 A1
US 20230209237 A1
WO 202210988 A1 (US 20220126126 A1)

I claim:

1. A modular air control device for forming an air curtain comprising:

a bottom board (2) further comprising a rectangular piece of a corrugated material of parallel rows of plastic tubes and each less than 50 square millimeters (0.078 square inches) cross sectional area and in a panel form, a seal at a one end designated as a sealed end (6), a lower trench (18) cut into a surface of the bottom board near the sealed end of the bottom board and fitting within the dimensions of a kneehole under an office desktop;

a case of thermal plastic (1) further comprising a flat top and four lateral walls with bottom edges which are sealed with a tape (3) to the bottom board and one lateral wall is positioned at an outboard edge of the lower trench;

a centrifugal blower (7) centered on a drive axis between two sides of the bottom board, positioned within the case, emitting noise at a low level, having a high speed, having a specification for a required power within a universal serial bus (USB) or a universal serial bus 2 (USB2) power supply specification and including a standard USB cable;

an air inlet (4) through the top of the said case and over the centrifugal blower;

a blower inlet (9) coinciding with the air inlet, sealed to the air inlet and fluidically receiving the air flow through the air inlet;

a blower outlet (8) directing the air flow toward said sealed end (6) and a dam (11) further directing the air flow;

a first transition piece (14) comprising an upper layer and a lower layer of said corrugated material fluidically connected to the blower outlet and fluidically receiving part of the air flow directed by the dam at a lateral angle from the blower outlet towards a first side;

a second transition piece (15) comprising the upper layer and the lower layer of the corrugated material fluidically connected to the blower outlet and fluidically receiving part of the air flow directed by the dam at a lateral angle from the blower outlet towards a second side;

a baffle (16) comprising the upper layer and the lower layer of the corrugated material fluidically connected to said first transition piece and the said second transition piece and fluidically receiving the air flow laterally from the first transition piece and the air flow laterally from the second transition piece, and the air flow impacting an entrance plane of the baffle and inducing turbulence within the baffle;

an upper trench (13) in the upper layer of the baffle and receiving the air flow from the baffle and balancing the air flow, separately, in two halves of the upper trench;

a mixing mask (17) comprising a strip of plastic in said lower trench (18) in said bottom board, shaped and positioned at assembly time, mixing the air, tuning the contribution of each of the air flow paths, connected fluidically to the baffle and receiving the air flow in a 90 degree turn from the upper trench and the baffle;

an air discharge (5) fluidically receiving the air flow from the lower trench in the bottom board, in a reversed flow path from said sealed end (6) of the bottom board and a length of the bottom board to exit out of the bottom board, in said air curtain of between 3 and 7 mm (0.12 and 0.28 in) in thickness, in a laminar flow and in a nearly equal velocity across its width.

* * * * *